United States Patent [19]

Rece et al.

[11] Patent Number: 4,958,667

[45] Date of Patent: Sep. 25, 1990

[54] TUBE HOLDER FOR TUBE FILLING MACHINES

[75] Inventors: Wesley J. Rece, California, Ky.; Martin M. Wildmoser, Florence, both of Ky.; Eric W. Scarpa, Cincinnati, Ohio

[73] Assignee: R. A. Jones & Co., Inc., Covington, Ky.

[21] Appl. No.: 380,307

[22] Filed: Jul. 17, 1989

[51] Int. Cl.[5] ..... B65G 47/24

[52] U.S. Cl. ..... 141/165; 141/171; 141/113; 141/313; 141/369; 141/DIG. 1; 198/378; 198/395; 198/803.8; 198/803.15; 269/8; 269/254 R; 285/9.1

[58] Field of Search ..... 141/113, 165, 168, 171, 141/313, 374, 378, 369, DIG. 1; 198/378, 379, 395, 803.8, 803.15, 803.14, 373–377, 381; 53/284; 269/254 R, 99, 8, 100, 104, 107, 108, 267; 401/100; 285/9.1

[56] References Cited

U.S. PATENT DOCUMENTS

| | | | |
|---|---|---|---|
| 2,162,464 | 6/1939 | Soderberg | 141/165 |
| 2,376,161 | 5/1945 | Maud et al. | 198/379 X |
| 2,557,140 | 6/1951 | Razdowitz | 285/9.1 X |
| 2,574,157 | 11/1951 | Reichert | 279/66 |
| 2,678,228 | 5/1954 | Gerhardt | 285/9.1 X |
| 3,390,891 | 7/1968 | Stichhan | 269/254 R |
| 3,819,194 | 6/1974 | Grevich et al. | 198/803.8 X |
| 4,640,406 | 2/1987 | Willison | 198/377 |
| 4,819,789 | 4/1989 | Linner | 198/803.8 |

*Primary Examiner*—Henry J. Recla
*Assistant Examiner*—Casey Jacyna
*Attorney, Agent, or Firm*—Wood, Herron & Evans

[57] ABSTRACT

A tube holder is adapted to be positioned in a ring on the conveyor of the tube filling machine. The tube holder is cup-shaped and has a central, generally cylindrical, tube gripper consisting of eight upwardly extending fingers. The fingers have radially inwardly directed pads on their upper ends. The fingers lean radially inwardly. When a tube is placed in them, they flex outwardly and provide a friction grip to the tube.

5 Claims, 1 Drawing Sheet

TUBE HOLDER FOR TUBE FILLING MACHINES

BACKGROUND OF THE INVENTION

This invention relates to a tube filling machine and particularly to the holder for frictionally gripping a tube as it is carried through the registration, filling, and crimping stations.

In a tube filling machine, a tube is frictionally placed in a holder with the cap end down and an open end facing upwardly. The tube is filled and thereafter sealed with a crimp across the upper end. The crimp may either be of the folded type used with metal tubes or of the heat sealed type used with plastic tubes. The important aspect of the crimp is that it must be properly oriented with the printed matter on the tube.

The tubes are placed in their holders in the tube filling machine in a random orientation. It is, therefore, necessary to rotate the tube to its correct position before it is filled and crimped so that after crimping the crimp will be properly oriented with respect to the printed matter.

To accomplish the rotation of the tube to the correct position, it is known to frictionally grip the tube in a holder, the holder being placed loosely in a ring carried by the tube filling conveyor. The holder has a central gripper and the tube is pushed into the central gripper.

The tube, thus held, is stopped at a registration station where there is provided a rotator that rises from underneath the holder to engage the holder and rotate it. An electric eye positioned to detect a registration mark on the tube stops the rotator when the electric eye has properly positioned the tube for subsequent filling and crimping.

The registration station places a limitation on the speed of the tube filling machine. Therefore, it is desired to rotate the tube holder as rapidly as possible. This rapid rotation, in turn, requires a good friction grip on the tube, for otherwise the tube, through its inertia, could slip past its correct angular position when the rotator rapidly stops the tube holder.

A tube holder in widespread use bears U.S. Pat. No. 2,574,157. It has multiple parts. It has an outer cylinder and an interchangeable gripper that is secured to the outer cylinder by a snap ring so that it can be replaced by grippers of different dimensions to accommodate tubes of different diameters. The inner gripper is a cylindrical element that has plural windows in its side walls. Plastic gripping jaws are radially slidable in the windows of this cylindrical element. A garter spring surrounds the plastic jaws and urges them radially inwardly to provide the frictional grip on the tube. This complication is required because of the wide variation of the dimensions of tubes of the given nominal diameter. For example, the diameter of a nominally one inch tube may vary as much as 0.035".

The known tube holder thus described is expensive, selling for about $85 a unit. It has one technical problem, namely, that, under some circumstances, it tends to dent metal or laminated tubes when they are crimped. In the crimping process the tube is distorted from a cylindrical shape to an oval shape, and the major dimension of the oval shape pushes against the upper edge of the gripping cylinder putting a dent in the surface of the tube.

SUMMARY OF THE INVENTION

An objective of the present invention has been to provide a significantly less expensive tube holder, and one that is more reliable in gripping tubes, and one which is forgiving of any distortions that are imparted to the tube in the crimping operation, thereby eliminating any denting in the tube.

Another objective of the present invention has been to improve the engagement of the rotator and the tube holder.

The objectives of the present invention are attained by providing a unitary plastic holder adapted to sit loosely in the conventional ring mounted on the conveyor of the tube filling machine. The integral plastic holder has a cup-shaped outer section and an inner, generally cylindrical, gripper consisting of a plurality of upwardly projecting flexible plastic fingers. The plastic fingers, when unstressed, preferably lean radially inwardly so that their upper surfaces define a circle that is about 10% smaller in diameter than the nominal diameter of the tube. Thus, when a tube is pushed down into the holder, it expands the fingers and the fingers, in turn, provide a frictional grip upon the outer surface of the tube.

One of the features of this holder is that it can be molded very inexpensively at a cost of about $5.00. Different holders are required for different diameter tubes, but that is simply accomplished by changing the core of the mold for making the tube holder so that the gripping fingers define circles of differing diameters. To change the machine from one tube size to another, all that is required is to change the complete tube holder rather than to take the tube holder apart and substitute a central gripper as required by the prior art. Maintaining different sized tube grippers is relatively inexpensive because of the exceedingly low cost of the holder itself.

The long flexible fingers that provide the gripping are very forgiving of the distortion of the tube during the crimping operation so that there is no denting of the tube as has been the case with prior art tube holders.

Another feature of the invention is to provide combined mating serrated edges on the tube holder and registration rotator, and an internal permanent magnet on the registration rotator, as well as a ferromagnetic ring on the bottom of the holder. With this combination, when the rotator rises to engage the tube holder and rapidly rotates, the combination of the mating serrated edges with magnetic elements holding the serrated edges in engagement keeps the tube holder from rotating beyond the desired position during the very rapid rotation and braking to a stop of the rotator.

Another advantage of the invention is that it is easy to clean.

Still another advantage of the invention is its low mass which, in the raising and spinning operation, makes registration easier.

BRIEF DESCRIPTION OF THE DRAWINGS

The several features of the invention will become more readily apparent from the following detailed description taken in conjunction with the accompanying drawings, in which.

DETAILED DESCRIPTION OF THE INVENTION

Figure 1:
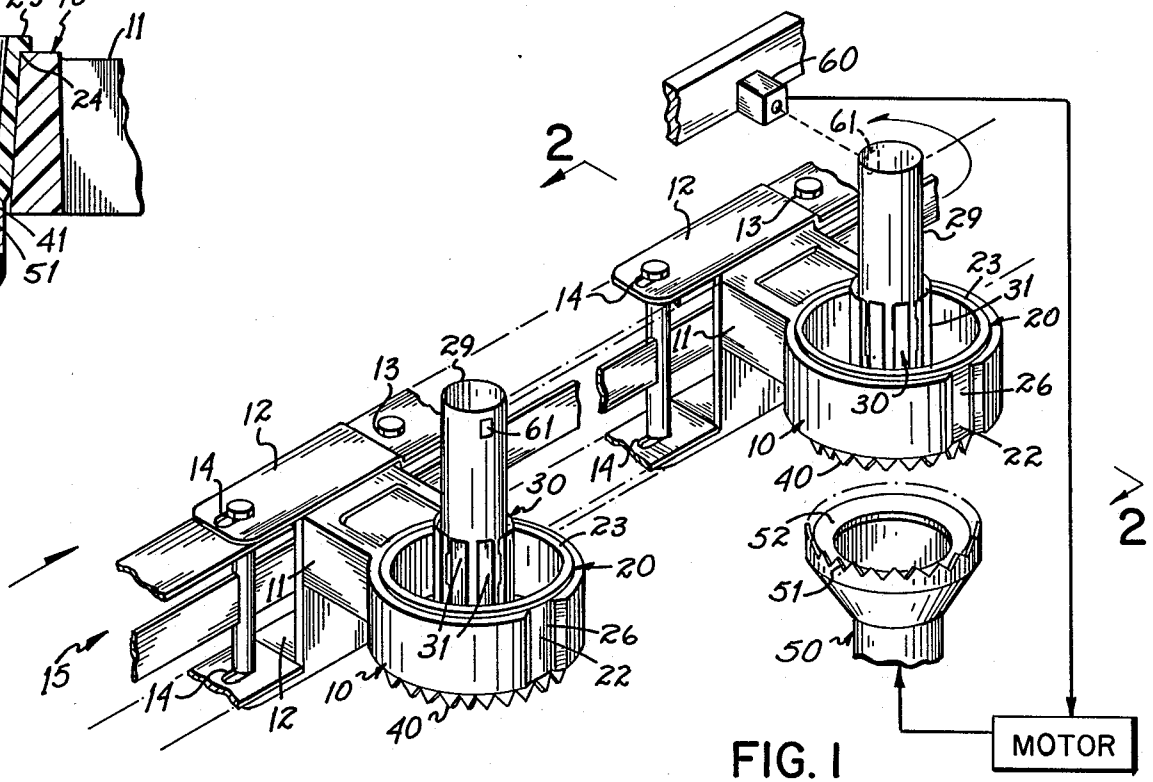
FIG. 1 is a partial perspective view of the tube holder in a tube filling machine.
Figure 2:
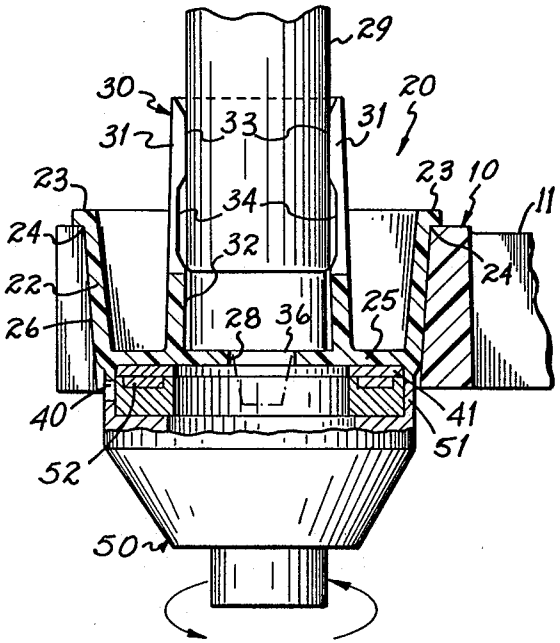
FIG. 2 is a cross-sectional view taken in lines 2—2 of FIG. 1.

Referring to the drawings in FIGS. 1 and 2, a ring 10 has a T-shaped bracket 11, which includes a crossbar 12. Holes 13 and 14 in the crossbar enable the bracket and ring to be mounted on an endless carrier 15 for conveying the ring 10 through the various stations of a tube filling machine. The oval-shaped hole 14 permits the ring to swing around the curved ends of the filling machine.

The ring 10 has an internal diameter of about 3". It is adapted to receive a tube holder 20. The tube holder has a cup-shaped section 22 terminating at its upper edge in an outwardly directed flange 23. The tube holder is molded integrally from a thermoplastic material, preferably super tough nylon. The cup-shaped element 22 has an outer diameter just below the flange 23, at the point, 24 of slightly less than 3" or about 0.010" less than the internal diameter of the ring 10. Thus, the tube holder 20 can loosely be dropped into the ring 10 and supported on the ring by the radially outwardly projecting flange 23.

The holder 20 has a bottom wall 25 integral with the side wall 26, thus forming the cup-shaped element 22. The bottom wall has a hole 28 through which caps of different shapes (shown in broken lines) on a tapered shoulder of a tube can project, thereby enabling the holder to accommodate tubes having large flat caps (as shown in FIG. 2) of about the same diameter of the tube 29, as well as the small caps mounted on tapered shoulders.

Molded integrally with the bottom wall is the gripper 30. The gripper 30 consists of eight (can vary) fingers 31 that project upwardly from a cylinder 32. Each finger 31 has at its upper end an inwardly directed pad 33 that engages the wall of the tube 29. The central portion 34 of each finger is thin so as to permit the fingers to flex outwardly. The lower portion at the cylinder 32 is of a smaller diameter than the internal diameter at the central portion 34 so as to tend to center the cap end of the tube when it is placed in the holder.

The centering is also assisted by the fact that the cap end of the tube 29 is normally flat and will be pushed against the flat surface 36 of bottom wall 25 so that the axis of the tube coincides with the vertical axis of the holder. Alternatively, a tube 29 having a small cap on a tapered shoulder will project through the opening 28, and the tapered shoulder engaging the hole 28 will also center and axially align the tube.

In FIG. 2 the pads 33 of the fingers 31 define an internal circle which preferably is about 10% smaller than the nominal diameter of the tubes to be gripped. This accomplishes two needs. First, the tubes can be undersized below the nominal diameter and still be well gripped. Further, the outward flexing of the fingers 31 which occurs when the tube is thrust into the gripper affords the desired frictional grip upon the tube to keep it in place when it is rapidly rotated and stopped by the registration apparatus.

The bottom wall 25 has a serrated flange 40. A ferromagnetic ring 41 is secured to the bottom wall.

In FIG. 1 the holder is carried by the ring 10 to a position over a rotator 50. The rotator has a known mechanism for raising it upwardly to engage the holder 20 and raise it upwardly about ⅜ of an inch. The rotator 50 has an upper serrated edge 51. A ring-shaped permanent magnet 52 is mounted in a holder just below the serrated edge. When the rotator 50 is raised to engage the holder, the serrated edge 51 mates with the serrated edge 40 and the permanent magnet 52 attracts the ferromagnetic ring 41 to hold the serrated edges in their mated position. A motor drive rapidly rotates the rotator 50 until an electric eye 60 detects the registration mark 61 on the tube 29 and immediately stops the rotator 50 at that position. Thereafter, the frictional relationship between the holder 20 and the ring 10, as well as the fingers 31 on the tube 29 maintain the tube in a proper orientation as the tube is conveyed through the filling and crimping stations.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A tube holder for carrying a tube through multiple processing stations of a tube filling machine which has a ring shaped support comprising;

a circular support having a lower edge and an upper edge with an annular flange at its upper edge adapted to removably seat said holder in said ring shaped support, said circular support having a bottom wall adjacent to said lower edge and extending radially inwardly therefrom, a plurality of flexible fingers integral with and projecting upwardly from said bottom wall about a central part thereof, said fingers having free upper end portions whose inner surfaces define a cylinder, said inner surfaces being engageable with a cylindrical tube to frictionally hold said tube in said holder during its excursion through said processing stations, said circular support, bottom wall and flexible fingers being an integrally-molded, one piece plastic element.

2. A tube holder as in claim 1 further comprising, radially inwardly projecting pads on the upper end portions of said fingers.

3. A tube holder as in claim 1 in which said fingers in an unstressed state are angulated radially inwardly from said bottom wall to their ends, the lower ends of said fingers defining a circle of a larger diameter than the tube to be received.

4. A tube holder as in claim 1, said bottom wall within said central part having a hole through which a cap and tapered shoulder of a tube can project to center said tube at its cap end.

5. A tube holder which is receivable by a circular rotator having a serrated rim and a central magnet comprising;

a plastic cup-shaped section having a bottom wall which has an underside, a plastic gripper for holding said tube projecting upwardly from said bottom wall, a serrated rim projecting downwardly from said bottom wall, and a ring of magnetically-attractable material secured to the underside of said bottom wall, said rim being engageable by a mating serrated rim of a rotator that has a central magnet that holds said holder onto said rotator.

* * * * *